US008243978B2

(12) United States Patent
Adelman

(10) Patent No.: US 8,243,978 B2
(45) Date of Patent: Aug. 14, 2012

(54) TRANSDUCER WITH VARIABLE COMPLIANCE

(75) Inventor: Roger A. Adelman, Villa Hills, KY (US)

(73) Assignee: Technology Properties Limited, Cupertino, CA (US)

( * ) Notice: Subject to any disclaimer, the term of this patent is extended or adjusted under 35 U.S.C. 154(b) by 575 days.

(21) Appl. No.: 12/395,289

(22) Filed: Feb. 27, 2009

(65) Prior Publication Data

US 2009/0161906 A1 Jun. 25, 2009

Related U.S. Application Data

(63) Continuation-in-part of application No. 11/511,170, filed on Aug. 28, 2006, now Pat. No. 7,577,269.

(51) Int. Cl.
*H04R 1/00* (2006.01)

(52) U.S. Cl. ..... 381/417; 381/424

(58) Field of Classification Search ..... 381/150, 381/396, 398, 412, 417, 418, 420, 421; 340/384.73, 340/388.4, 391.1; 367/175
See application file for complete search history.

(56) References Cited

U.S. PATENT DOCUMENTS 7,577,269 B2 * 8/2009 Adelman ..... 381/417
* cited by examiner

*Primary Examiner* — Brian Ensey
(74) *Attorney, Agent, or Firm* — Porter Wright Morris & Arthur

(57) ABSTRACT

A transducer utilizes a sound-producing member positioned in the area of magnetic flux concentration between magnetic poles of opposite polarity. The sound-producing member is variably vibratable in a magnetic structure between the poles to generate acoustic waves, and an acoustic conduit carries the acoustic waves through the magnetic poles e to a location outside the magnetic structure.

9 Claims, 2 Drawing Sheets

TRANSDUCER WITH VARIABLE COMPLIANCE

RELATED APPLICATIONS

This is a continuation-in-part of U.S. patent application Ser. No. 11/511,170, filed Aug. 28, 2006 now U.S. Pat. No. 7,577,269.

FIELD OF THE INVENTION

The present invention generally relates to the field of electro acoustic transducers. While the invention has applicability to a wide range of diverse applications, it will be specifically disclosed in connection with a speaker for producing airborne sound waves.

BACKGROUND OF THE INVENTION

Balanced armature electro acoustic transducers have long been fundamental components of communications equipment ranging from telephones to hearing aids. In essence, this type of speaker uses an armature positioned in an area of magnetic flux created by opposite poles of a magnet. An alternating current typically is passed through a coil positioned around the armature. This induces a fluctuating magnetic flux in the armature to change the magnetic polarity of a portion of the armature positioned between opposite poles of a magnet. The polarity of the armature depends on the direction of the AC current running through the coil, and the armature is attracted to one or the other of the magnetic poles of the magnet in an alternating sequence. This causes the armature to vibrate, and the vibrating movement of the armature is then used, either directly or indirectly, to move air and to thereby create sound waves.

A limitation to the performance of conventional balanced armature electro acoustic devices, whether used as speakers or microphones, is that their characteristic frequency spectra deviate from being perfectly flat, spectral flatness being one representation of a lack of distortion, a very desirable characteristic for acoustic (and most other) transducers. This spectral deviation or "signature" arises from the fundamental structural properties that are characteristic of all conventional balanced armature devices: the mass and springiness of the armature itself, the sound producing diaphragm and its chamber(s), and, in most conventional speaker of this type, the connector element and its attachments that link the armature and the diaphragm. Numerous techniques have been developed to minimize the disadvantages of this inherent signature, including, for example, the use of so-called "ferro-fluids" for damping the system and improving the transducer's dynamic performance.

Notwithstanding the substantial enhancements to these general types of transducers, room remains for improving and simplifying the frequency signature, minimizing the frictional and other mechanical losses, and improving the efficiency of this type of speakers. In many applications, it also is desirable to further reduce the size of the transducer. For example, when used in a hearing aid or earphone application, it is desirable to have a transducer that is small enough to comfortably fit within a human auditory canal. Similarly, when used as a component of a device such as a cell phone, the small size of the transducer allows the size of the device to be minimized.

SUMMARY OF THE INVENTION

According to one exemplary embodiment of the invention, the first ("free") end of the armature is affixed to the vibratable sound-producing member producing thereof an integral element.

According to another exemplary embodiment of the invention, the vibratable sound-producing member is a diaphragm.

In another exemplary embodiment, different radial circumferential portions of the diaphragm have different flexibilities.

In another exemplary embodiment, the diaphragm includes a flexibility enhancing structure disposed circumferentially about the periphery of the diaphragm to enhance the flexibility of the diaphragm and reduce resistance to movement of the diaphragm in a direction substantially perpendicular to the plane of the diaphragm.

In another exemplary embodiment, the flexibility enhancing structure is a surround.

According to another exemplary embodiment, the thickness of the diaphragm in the direction substantially perpendicular to the plane of the diaphragm is variable, with at least one radially outward circumferential portion of the diaphragm having a reduced thickness relative to the thickness of the central portion of the diaphragm.

In another exemplary embodiment, different circumferential portions of the diaphragm are formed of different materials, with the material forming the radially outward circumferential portion of the diaphragm having greater flexibility that is greater than the material in the central portion of the diaphragm.

In another exemplary embodiment, the diaphragm includes a central portion and a radially outward circumferential portion with the radially outward circumferential portion having a magnetic permeability that is substantially less than the magnetic permeability of the central portion.

In another exemplary embodiment, the diaphragm includes a central portion and a radially outward circumferential portion with the radially outward circumferential portion having a lower specific mass than the central portion.

In another exemplary embodiment the armature has a non-uniform geometry configured to enhance flexibility of the armature in an area proximal to the sound-producing member.

In another exemplary embodiment, the non-uniform geometry includes a notch.

BRIEF DESCRIPTION OF THE DRAWINGS

The accompanying drawings incorporated in and forming a part of the specification illustrate several aspects of the present invention, and together with the description, they serve to explain the principles of the invention. In the drawings.

Reference will now be made in detail to certain exemplary embodiments of the invention, examples of which are illustrated in the accompanying drawings.

DETAILED DESCRIPTION OF EXEMPLARY EMBODIMENTS

Figure 1:
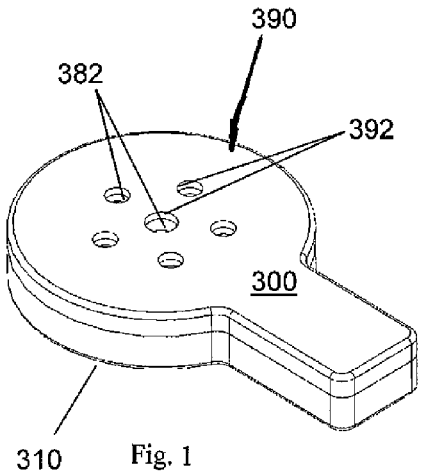
FIG. 1 is a perspective view showing the exterior of one exemplary embodiment illustrating some of the principles of the present invention.
Figure 3:
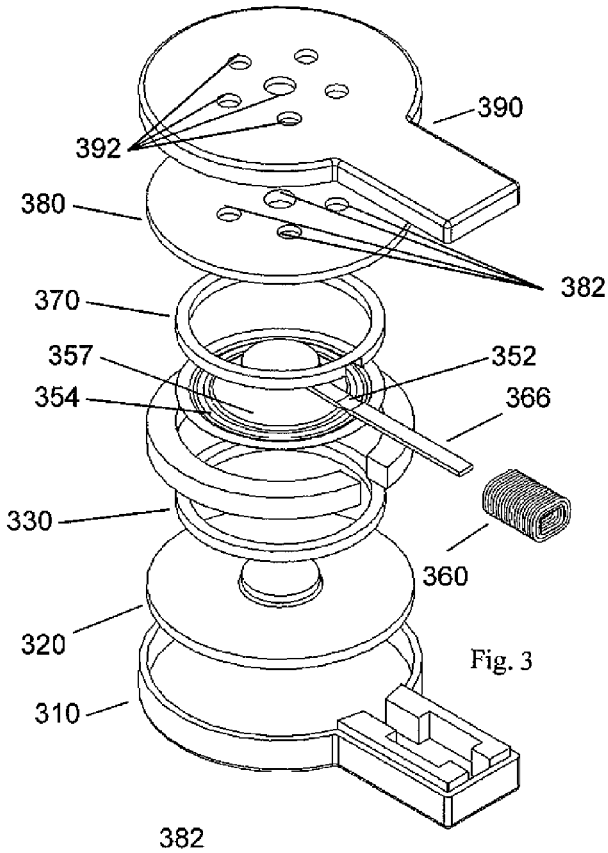
FIG. 3 is an exploded view of the exemplary embodiment of FIG. 3.
Figure 2:
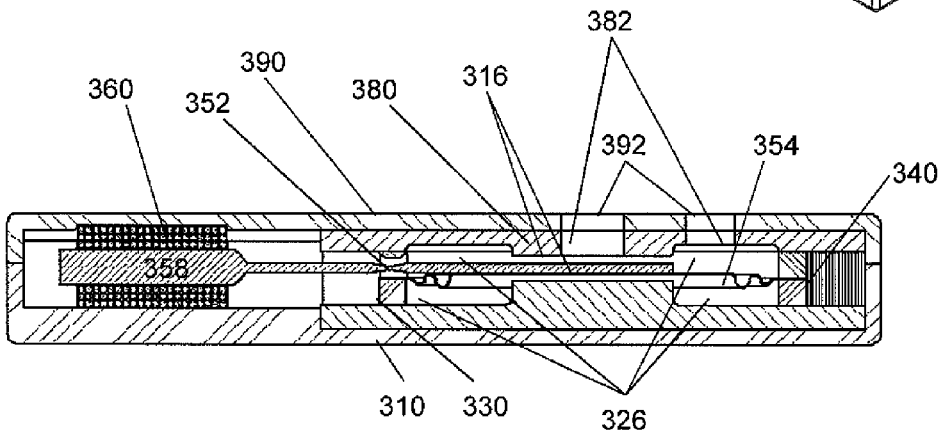
FIG. 2 is a cross-sectional view of the exemplary embodiment of FIG. 1.

FIGS. 1-3 show an exemplary embodiment of the present invention in a form utilizing an integrated armature/diaphragm. In this exemplary embodiment, a transducer is enclosed within a support structural, as for example the housing 300 that encloses the transducer. As illustrated, the support structure 300 is in the form of a case, and includes an upper case portion 390 and a lower case portion 310. The support structural 300 contains a magnet 340 (see FIGS. 2 and 3), which in this specifically illustrated embodiment has an annular configuration. A magnetic field is produced in a magnetic flux area or an air gap or magnetic flux area 316 (see FIG. 2) located between the opposite magnetic poles formed between an upper magnetic pole piece 380 and a lower pole piece 320. Exemplary suitable permeable ferro-magnetic materials from which pole pieces 380 and 320 might be made include iron, low carbon (soft) steel, or mu-metal (e.g. Carpenter Steel Corporation "High mu 80"). In the exemplary form illustrated, an acoustic conduit is formed in upper pole piece 380 by piercing through the upper pole piece 380 to form holes 382. The illustrated exemplary embodiment further includes correspondingly aligned holes 392 (see FIGS. 1 and 3) in upper case portion 390. These aligned holes form an acoustic path through which a fluid, such as air, maintains contiguous relationship with fluid present on the inside of pole piece 380 and the outside of upper case 390. The magnetic structure, exemplarily illustrated as an annular magnet 340 may be a permanent magnet or it may be an electromagnet built using well-known principles of winding a coil around a magnetically permeable form. As those skilled in the art will readily appreciate, if an electromagnet is used, an electric current is supplied to the coil to form a magnetic field.

Figure 4:
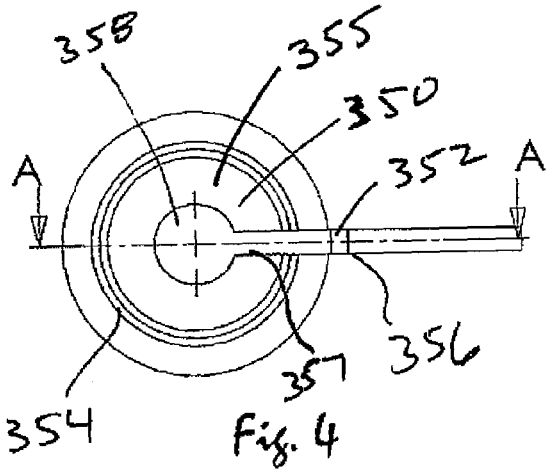
FIG. 4 is a plan view of an integrated armature/diaphragm used in the exemplary embodiment of FIGS. 1-3.
Figure 5:
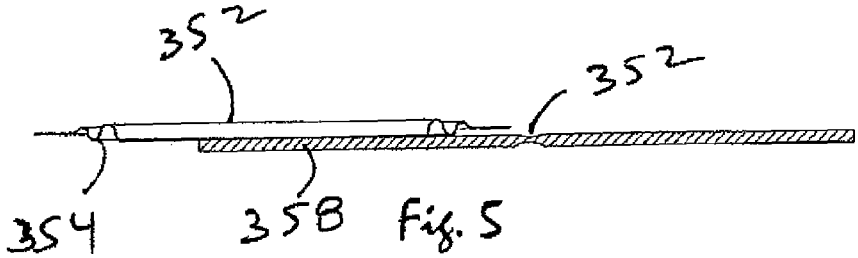
FIG. 5 is a perspective view of the integrated armature/diaphragm of FIG. 4.
Figure 6:
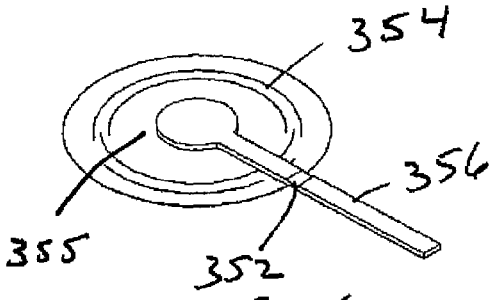
FIG. 6 is a cross sectional view of the integrated armature/diaphragm of FIG. 4.
Figure 6A:
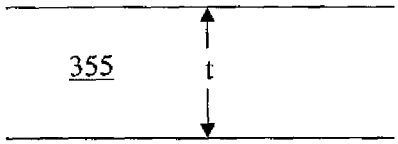
FIG. 6A is a schematic view depicting the relative thickness of one portion of the armature/diaphragm.
Figure 6B:
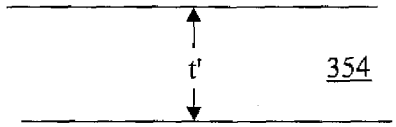
FIG. 6B is a schematic view depicting the thickness of another portion of the same armature/diaphragm.

As best illustrated in FIGS. 4-6, this exemplary embodiment includes a vibratable sound-producing member 350, specifically illustrated in this drawing figure as an armature that is integrated with a diaphragm. The illustrated armature/diaphragm 350 includes at least a portion of magnetically permeable material 358. The illustrated armature/diaphragm 350 also has a cantilevered geometry with a base portion 366 of the armature or bean structure 356 being rigidly affixed a into the magnetic coil structure 360 (See FIGS. 2 and 3). The diaphragm portion 357 forming the "free" end of the armature/diaphragm 350 (See FIG. 4) is such that the magnetic forces in the air gap 316 just balance the supporting forces. A soundproducing surface 355 is intimately affixed to the magnetically permeable material 358 so as to be integral with the armature or bean structure 356 and create the integrated armature/diaphragm 350. A flexibility enhancing structure, such as a compliance-producing surround 354 is also integrally disposed peripherally with sound producing surface 355 and is also continuously affixed to upper support ring 370 (See FIG. 3) and lower support ring 330 on its flexible "surround" periphery 354. The illustrated surround 354 enhances the overall flexibility of the armature/diaphragm 350, either by utilizing a different, more flexible material in a radially outward circumferential portion of the diaphragm portion 357 than in the remaining central portions 355, or by including extra folded material that will allow greater movement of the diaphragm portion 357 in the direction generally perpendicular to the plane of the armature/diaphragm. The flexibility enhancing structure also can be accomplished by reducing the thickness of the radially outward portion 354 of the armature/diaphragm 358 relative to the central portion of the armature/diaphragm. FIG. 6A schematically depicts the thickness of a radially inward portion the diaphragm component 357, the portion 355, having a thickness t. FIG. 6B schematically depicts a radially outward portion of the same diaphragm, portion 354, having a thickness t'. In the illustrated embodiment, thickness t is greater than thickness t'.

An electrical to magnetic coil 360 is wound around a portion 356 of the armature 350 at a position between its fixed and movable ends. Acoustic cavities 326 (see FIG. 2) are formed within case structure 310 inside of lower pole 320 to as one form of acoustic tuning means. The support structure 300 further provides a structural support to the fixed end 326 of the beam 356 as well as the annular magnet 340 and poles 320 and 380.

FIGS. 4-6 further illustrate exemplary functional geometry of the armature and proximally located diaphragm of one exemplary embodiment of the armature/diaphragm 350. In the exemplary embodiment illustrated, the beam portion 356 of the armature/diaphragm has a non-uniform geometry at two locations, a first location non-uniform region form of an expanse region 358, and a second region in the form of a notch region 352.

The beam portion 356 of the armature/diaphragm 350 preferably is made of a material with a relatively high magnetic permeability, such as iron, low carbon (soft) steel, or mu-metal (e.g. Carpenter Steel Corporation "High mu 80"). To further maximize the amount of magnetic flux that is communicated along the beam portion 356 to the diaphragm portion 357, which diaphragm portion is positioned in the gap 316, it may be desirable to maximize cross-sectional area of the beam portion 356. Further, to maximize the magnetic attraction between the diaphragm portion 357 and the opposite poles of the magnetic pole pieces 380 and 320 (see FIGS. 2 and 3), it may be desirable to maximize the mass of the portion of the beam 356 that is integral with the diaphragm. Each of these modifications, however, has corresponding disadvantages. Specifically, increasing the cross-sectional area of the beam 356 may result in a non-optimal compliance of the beam. Similarly, increasing the mass of the portion of the beam integrated with the diaphragm may adversely affect the flexibility of the diaphragm, and reduce its potential movement. To overcome these disadvantages, it may be desirable for the beam 356 to include a compliance altering geometry, such as the notch depicted at location 352. The notch at location 352 facilitates flexure of the beam 356 in a plane generally perpendicular to both the long axis of beam armature 356 and diaphragm 357. As those skilled in the art will appreciate, other forms of compliance altering geometry, such as a sinuous or ripple region in the beam might be employed. As also shown in the exemplary embodiment illustrated in FIGS. 4-6, the beam portion 356 that is integrated into the diaphragm includes an expanse region 358, which expanse region 358 is generally in the plane of the diaphragm 357.

In order to maximize the range of materials available to achieve the desired functionality, it may be desirable to form different regions of the armature/diaphragm of different materials. For example, in order to obtain the desired magnetic flux transfer along the beam 356, a permeable ferromagnetic material such as iron, low carbon (soft) steel, or mu-metal (e.g. Carpenter Steel Corporation "High mu 80") might be used in the central region identified by numeral 358. In order to increase the flexibility of the diaphragm, however, a more flexible material, such as Mylar might be preferable on the radially outmost portions of the diaphragm. With such a configuration, the central portion of the diaphragm might be formed of the highly permeable material, with the radially outward circumferential portion being formed of more flexible, but less permeable material such as a biaxially-oriented polyethylene terephthalate polyester film (such as the film sold under the trademark Mylar). Using this type of material on the radially outward circumferential portion of the diaphragm results in a combination in which the magnetic permeability of the radially outward circumferential portion of the diaphragm is less than the magnetic permeability of the central portion, and concentrates the magnetic forces to the central region. Variations of these mass and compliance features can, of course, be demonstrated in other than the planes shown.

In operation, the total structure of sound generating member 350 has fixed support around the outer periphery of the diaphragm 355 and at the extended region of beam armature 356. Sound is generated when the diaphragm region is caused to move under the influence of the interaction of magnetic fields described above in response to a varying electrical current in the coil, as for example an alternating current. The combined structural mechanics of the diaphragm 355, the beam armature 356 and the sound conducting fluid (not shown) all contribute to the frequency response for the structure. Altering the shape and/or thickness of the surround 354 will change the springiness of the dynamic structure of sound generating member 350, and altering the thickness and/or material of the diaphragm 355 will change the mass or the dynamic structure of sound generating member 350. Similarly, altering the shape and/or thickness of the beam armature 356 as exemplified by compliance altering feature 352 will change the springiness of the dynamic structure of sound generating member 350, and altering the thickness and/or material of the beam armature 356 itself, also will change the mass or the dynamic structure of sound generating member 350. It is noted that the change in thickness of the beam armature 356 as shown will affect its magnetic permeability in relationship to its thickness to the first power, whereas such thickness change alters the springiness to the third power of the thickness. It is well known that the overall relationship of springiness to mass affects the dynamic vibration spectrum as the square root of the ratio numerical value of the springiness to the mass of the entire structure, and preselected variations to the structures as shown serve to adjust the dynamic signature (along with other sound altering geometry in the sound path) of the acoustic transducer.

The foregoing description of preferred embodiments of the invention has been presented for purpose of illustration and description. It is not intended to be exhaustive or to limit the invention to the precise form disclosed. Obvious modifications or variations are possible in light of the above teachings. The embodiments were chosen and described in order to best illustrate the principles of the invention and its practical applications to thereby enable one of ordinary skill in the art to best utilize the invention in various embodiments and with various modifications as are suited to the particular use contemplated. It is intended that the scope of the invention be defined by the claims appended hereto.

What is claimed is:

1. An electromagnetic transducer, comprising:

(a) a support structure, the support structure supporting a pair of magnetic poles, the pair of magnetic poles creating a first region of magnetic flux concentration; and (b) an integrated armature/diaphragm structure, the armature/diaphragm structure including beam, a coil and a diaphragm, the diaphragm being affixed to an end portion of the beam, and the coil being operative when energized by an electric current to create a second region of varying magnetic flux concentration proximal to an end of the beam, the beam and diaphragm being magnetically movable between the magnetic poles in the first region in response to the interaction of the first and second regions of magnetic flux concentration.

2. An electromagnetic transducer as recited in claim 1 wherein armature/diaphragm has different radial portions, and different radial portions of the armature/diaphragm have different flexibilities.

3. An electromagnetic transducer as recited in claim 1 wherein the armature/diaphragm includes a surround disposed circumferentially about the periphery of the armature/diaphragm, the surround portion of the armature/diaphragm being operative to enhance the flexibility of the armature/diaphragm, and reduce resistance to movement of the armature/diaphragm in a direction substantially perpendicular to the plane of the armature/diaphragm.

4. An electromagnetic transducer as recited in claim 1 wherein the armature/diaphragm has a thickness in the direction substantially perpendicular to the plane of the armature/diaphragm is variable, with at least one radially outward circumferential portion of the armature/diaphragm having a reduced thickness relative to the thickness of the central portion of the armature/diaphragm, whereby the reduced thickness enhances flexibility of the diaphragm and reduces resistance to movement of the armature/diaphragm in a direction substantially perpendicular to the plane of the armature/diaphragm.

5. An electromagnetic transducer as recited in claim 1 wherein different circumferential portions of the armature/diaphragm are formed of different materials, with the material forming the radially outward circumferential portion of the armature/diaphragm having greater flexibility than the materials in the central portion of the armature/diaphragm.

6. An electromagnetic transducer as recited in claim 1 wherein the armature/diaphragm includes a central portion and a radially outward circumferential portion, with the radially outward circumferential portion having a magnetic permeability that is substantially less than the magnetic permeability of the central portion.

7. An electromagnetic transducer as recited in claim 1 wherein the armature/diaphragm includes a central portion and a radially outward circumferential portion, the radially outward circumferential portion having a lower specific mass than the central portion.

8. An electromagnetic transducer as recited in claim 1 wherein the armature has a non-uniform geometry configured to enhance flexibility of the armature in an area proximal to the sound-producing member.

9. An electromagnetic transducer as recited in claim 1 wherein the armature/diaphragm has a non-uniform geometry, and the non-uniform geometry includes a notch.

* * * * *